US006401364B1

(12) United States Patent
Burt

(10) Patent No.: US 6,401,364 B1
(45) Date of Patent: Jun. 11, 2002

(54) VENTILATED SHOE

(75) Inventor: Igor Burt, Boulder, CO (US)

(73) Assignee: Salomon S.A., Annecy (FR)

( * ) Notice: Subject to any disclaimer, the term of this patent is extended or adjusted under 35 U.S.C. 154(b) by 0 days.

(21) Appl. No.: 09/594,552

(22) Filed: Jun. 15, 2000

(51) Int. Cl.[7] ..... A43B 7/06

(52) U.S. Cl. ..... 36/3 A; 36/3 R; 36/45; 36/9 R

(58) Field of Search ..... 36/3 R, 3 A, 45, 36/84, 87, 88, 54, 55, 9 R

(56) References Cited

U.S. PATENT DOCUMENTS

| | | | | | |
|---|---|---|---|---|---|
| 1,958,135 | A | * | 5/1934 | Dunbar | 36/45 |
| 2,052,753 | A | * | 9/1936 | Daniels | 36/3 A |
| 2,350,879 | A | * | 6/1944 | Daniels | 36/45 |
| 3,583,081 | A | | 6/1971 | Hayashi et al. | |
| 4,005,532 | A | * | 2/1977 | Giese et al. | 36/44 |
| 4,043,058 | A | * | 8/1977 | Hollister et al. | 36/102 |
| 4,073,073 | A | * | 2/1978 | Gross et al. | 36/44 |
| 4,222,183 | A | * | 9/1980 | Haddox | 36/45 |
| 4,232,458 | A | * | 11/1980 | Bartels | 36/45 |
| 4,447,967 | A | * | 5/1984 | Zaino | 36/45 |
| 4,458,429 | A | * | 7/1984 | Schmid | 36/3 A |
| 5,771,610 | A | * | 6/1998 | McDonald | 36/3 A |
| 6,108,943 | A | * | 8/2000 | Hudson et al. | 36/45 |

FOREIGN PATENT DOCUMENTS

| | | |
|---|---|---|
| DE | 19 48 632 | 10/1966 |
| DE | 92 13 747 | 1/1993 |
| DE | 296 05 216 | 8/1996 |
| FR | 2 681 514 | 3/1993 |
| WO | WO 99/43229 | 9/1999 |

* cited by examiner

*Primary Examiner*—M D Patterson
(74) *Attorney, Agent, or Firm*—Oblon, Spivak, McClelland, Maier & Neustadt, P.C.

(57) ABSTRACT

A ventilated shoe having an external layer, a reinforcing layer, and an internal layer, with both the external layer and the internal layer being made from a ventilated mesh material. The reinforcing layer provides a structure for reinforcing the shoe, and is generally positioned between a portion of the external layer and the internal layer. The reinforcing layer is sized and configured to permit the transmission of the fitting stress given by the shoes laces on the eyelets, to the sole portion of the shoe, thereby providing the upper portion of the shoe with durability and stability. The reinforcing layer is configured to provide the maximum amount of structural stability and durability to the shoe, while generally being utilized over a minimum area of the shoe in order to provide the shoe with the maximum porosity. The shoe includes stitching that connects the external layer to the reinforcing layer, which does not restrict the free flow of fluid along the internal layer, thereby allowing the fluid to travel along the internal layer and exit the shoe via open areas where a reinforcing layer is not present.

38 Claims, 4 Drawing Sheets

FIG.4a
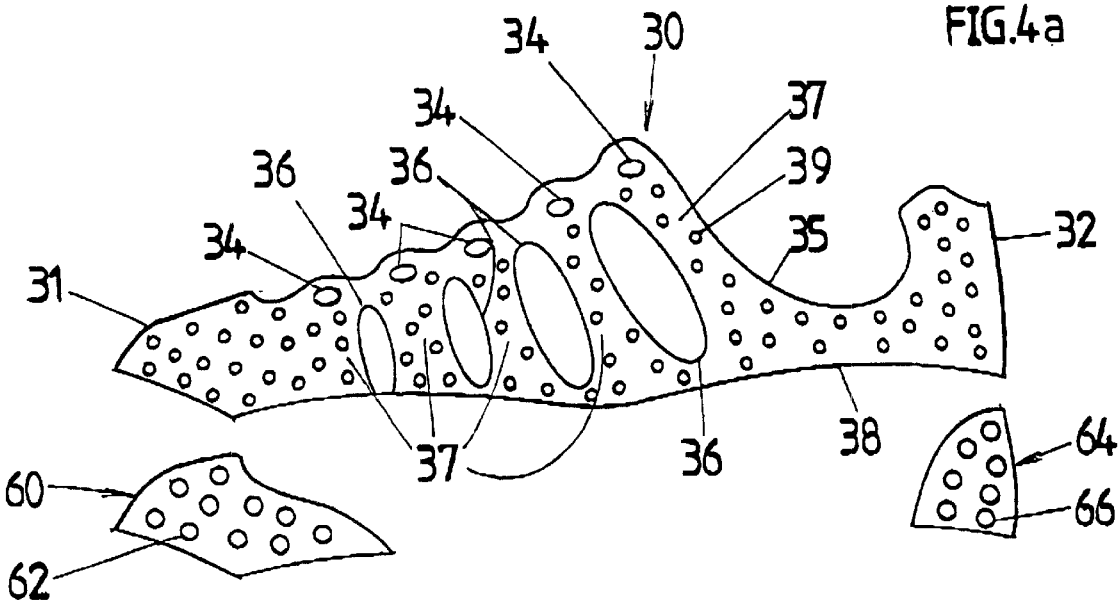
FIG.4b
FIG.4c
FIG.5
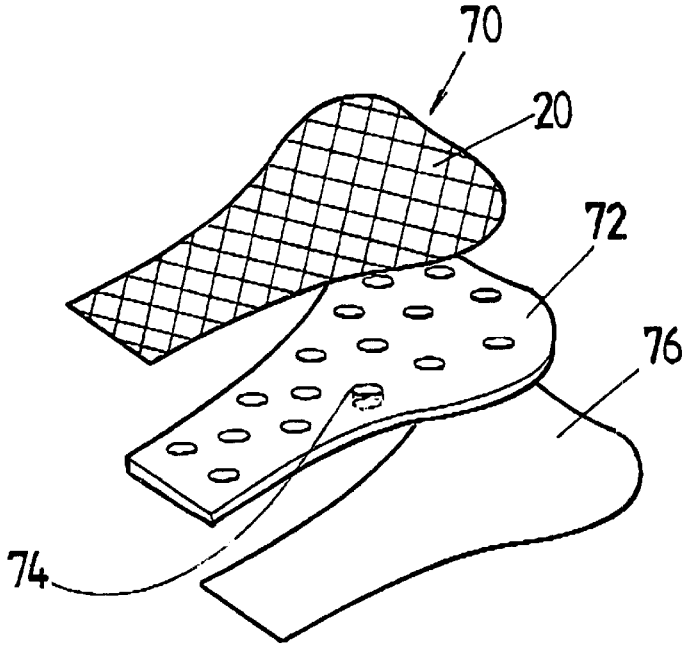

VENTILATED SHOE

BACKGROUND OF THE INVENTION

1. Field of the Invention

The present invention relates generally to a ventilated sport shoe, more specifically, a durable shoe formed of ventilated layers of material and a reinforcing layer.

2. Discussion of the Background

Many athletic activities require that an athlete perform strenuous activities for a limited period of time under hot weather conditions. Shoes constructed for such sporting activities are generally not very resistant to wear, and in some instances are constructed for use in only one single event, such as in a marathon race. When constructing a shoe it is indeed quasi impossible to reconcile opposite requirements such as lightness, ventilation, and durability. The inventor of the present invention has determined that it would be advantageous to construct a shoe, and specifically a sports and multi-activity shoe, that will allow a foot of a wearer to remain light, cool and dry under such conditions, while retaining high durability.

FIG. 6 depicts an athletic shoe 100 manufactured by Adidas that is constructed using a single layer of three-dimensional mesh material 102. The shoe 100 includes three bands 104 on each side that are provided on the exterior of the shoe 100, and that extend from the shoelaces 106 to a sole 108 of the shoe 100.

FIG. 7 depicts a marathon shoe 200 manufactured by Polo Sport that is constructed using a single layer of mesh material 202. The shoe 200 includes two reinforcement bands 204 on each side that are provided on the exterior of the shoe 200, and that extend from the shoelaces 206 to a sole 208 of the shoe 200.

The inventor has determined that positioning of bands on the exterior of the shoe is disadvantageous since the exterior of the shoe can occasionally contact other objects. For example, during a runner's stride, the exterior of the shoe on the instep side of the shoe can come into contact with the other leg of the runner, thereby scraping and causing discomfort to the leg. Accordingly, the inventor has determined that in such a shoe construction the selection of the material used to construct the band should be based at least partially on the softness of the exterior of such a band. This softness factor limits that types of materials that can be utilized for the bands, and can require the selection of an expensive material. An additional disadvantage to the shoes depicted in FIGS. 6 and 7 is that the bands do not provide stability or durability to the remainder of the shoe not covered by the bands.

When constructing shoes made for sporting or multi-activities, the durability of the shoe is particularly important. For example, the shoe should be resistant to abrasion against various surfaces such as rocks, and should be resistant to deformation and general wear. The inventor has determined that such durability issues are not fully addressed in the sport shoes discussed above.

Accordingly, the inventor has determined that a ventilated shoe is needed that will overcome the disadvantages discussed above.

SUMMARY OF THE INVENTION

An object of the present invention is to provide a ventilated shoe that is porous to allow fluids such as sweat and air to flow in and out of the shoe in order to keep the wearer's foot relatively cool and dry.

Another object of the present invention is to provide a shoe with a reinforcing layer that is sized and configured to permit the transmission of the fitting stress given by the shoes laces on the eyelets, to the sole portion of the shoe, thereby providing the upper portion of the shoe with durability and stability.

An additional object of the present invention is to provide a shoe with a reinforcing layer that positioned below an external layer and is configured to provide the maximum amount of structural stability and durability to the shoe, while generally being utilized over a minimum area of the shoe in order to provide the shoe with the maximum porosity.

A further object of the present invention is to provide a shoe that includes stitching that connects the external layer to the reinforcing layer, which does not restrict the free flow of fluid along the internal layer, thereby allowing the fluid to travel along the internal layer and exit the shoe via open areas where a reinforcing layer is not present.

The ventilated shoe according to the present invention includes an upper portion, which generally encloses a foot of a wearer, and a sole portion, which is affixed to the upper portion. The shoe is constructed using an external layer, a reinforcing layer, and an internal layer, with both the external layer and the internal layer being made from a ventilated mesh material. In the preferred embodiment, the external layer is made of mesh with abrasion resistance characteristics, and the internal layer is made of a three-dimensional mesh which is more comfortable to the wearer then mesh. The three-dimensional mesh is a loose configuration of fibers between a soft porous inner layer and an outer porous layer, which provide a porous layer that allows gases, such as air, and liquids, such as perspiration, to travel therethrough and in a longitudinal direction.

The reinforcing layer provides a means for reinforcing the shoe, and is generally positioned between a portion of the external layer and the internal layer. By positioning the reinforcing layer between the external layer and the internal layer, the reinforcing layer is isolated from both the wearer's foot and the exterior of the shoe, which allows the construction of the reinforcing layer to be based solely on the ability of the reinforcing layer to resist traction forces acting on the shoe, rather than aesthetic concerns, abrasion resistance concerns, or over whether the reinforcing layer will create discomfort for the wearer. Thus, this configuration allows the reinforcing layer to be constructed of inexpensive materials. The reinforcing layer can be constructed from non-ventilated material, or from ventilated material. The reinforcing layer is sized and configured to permit the transmission of the fitting stress given by the shoes laces on the eyelets, to the sole portion of the shoe, thereby providing the upper portion of the shoe with durability and stability. The reinforcing layer is configured to provide the maximum amount of structural stability and durability to the shoe, while generally being utilized over a minimum area of the shoe in order to provide the shoe with the maximum porosity. The reinforcing layer advantageously includes one or more openings that define open areas in the reinforcing layer. Since in the open areas within the openings there are only two layers, specifically the external layer and the internal layer, the open areas are more porous than areas that include the reinforcing layer and therefore the open areas allow fluids to travel in and out of the shoe more rapidly than in areas that include the reinforcing layer. The openings have structural members that extend therebetween that are configured to extend from the eyelet holes to the lower edge of the reinforcing layer, thereby transmitting the stresses placed on the eyelet holes of the shoe by shoelaces to the sole portion of the shoe.

The shoe of the present invention includes a means for connecting the external layer, the reinforcing layer, and the internal layer. The preferred means for generally connecting these layers is stitching, although other means for connecting can be used some places in combination with the stitching, such as glue. As compared to glue, which is not breatheable, the use of stitching generally improves signficantly the ability of the layers to allow air, sweat, or other fluids to travel through the porous layers of the shoe, which can help keep the wearer's foot relatively cool and dry.

The present invention includes stitching that extends from the external layer, through the reinforcing layer, and connects to the internal layer. Such stitching is beneficial in that it provides the maximum interconnection between the three layers, and therefore the maximum structural strength. However, such stitching has the tendency to pinch or compress the various layers together, which hinders the free flow of fluids along the individual layers. The travel of fluids along an individual layer is beneficial in that it allows for the distribution of sweat or other fluids over a large volume of layer material and towards more porous areas of the shoe, which allows the layer to dry and cool faster.

The present invention also includes stitching that connects the external layer to the reinforcing layer. Such stitching does not restrict the free flow of fluid along the internal layer, which allows the fluid to travel along the internal layer and exit the shoe via the open areas where a reinforcing layer is not present.

The present invention includes a reinforcing structure by forming stitching lines extending in a direction from the eyelet holes of the reinforcing layer and downward along the structural member of the reinforcing layer to the sole portion of the shoe. The stitching lines transmit stresses placed on the eyelet holes of the shoe by shoelaces to the sole portion of the shoe.

The shoe of the present invention preferably further includes a first secondary reinforcement layer attached on an exterior surface of the external layer at the toe part of the shoe and a second secondary reinforcement layer attached on an exterior surface of the external layer at a heel part of the shoe. The secondary reinforcement layers are constructed to provide protection to the shoe at high contact areas and are made of ventilated material, such as grid or mesh having a high abrasion resistance, such as nylon. The shoe of the present invention preferably further includes a secondary reinforcement layer attached on an interior surface of the internal layer at an eyelet part of the shoe.

The shoe of the present invention preferably includes a tongue portion that includes a layer of ventilated foam positioned beneath the external layer. The tongue portion also includes an inner cleanliness textile that is preferably attached to the foam. The shoe also preferably includes a layer of ventilated foam extending about the ankle portion of the shoe.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 4A, 4B, and 4C are side views of a reinforcement layer and reinforcement members;

FIG. 5 is an exploded, perspective view of a tongue of a ventilation shoe according to the present invention;

DESCRIPTION OF THE PREFERRED EMBODIMENTS

Figure 1:
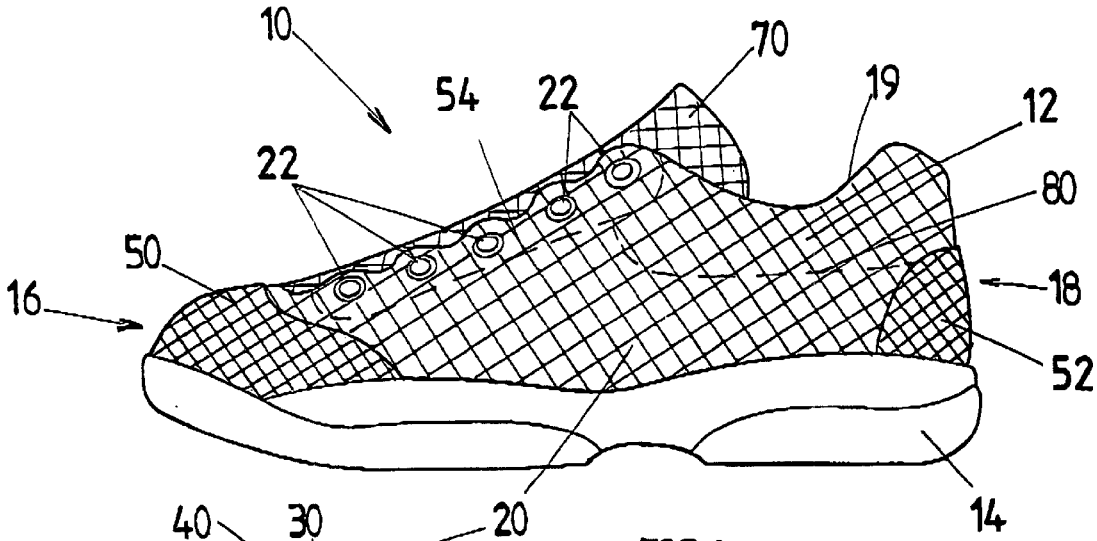
FIG. 1 is a side external view of an embodiment of a ventilated shoe according to the present invention where the stitches are not depicted for better comprehension of the invention.

Referring now to the drawings, where like reference numerals identify the same or corresponding parts throughout the several views, FIGS. 1 though 5 set forth various embodiments of a ventilated shoe according to the present invention.

FIG. 1 depicts an embodiment of a ventilated shoe 10 according to the present invention. The shoe 10 includes an upper portion 12, which generally encloses a foot of a wearer, and a sole portion 14, which is affixed to the upper portion 12 using, for example, glue and/or stitching. The shoe 10 generally includes a toe part 16 at a forward end of the shoe 10, and a heel part 18 at a rearward end of the shoe 10. The shoe 10 further includes an opening 19 that allows the wearer of the shoe 10 to insert a foot therethrough, and that is adjacent to the wearer's ankle once the shoe 10 is properly positioned on the wearer's foot.

Figure 2A:
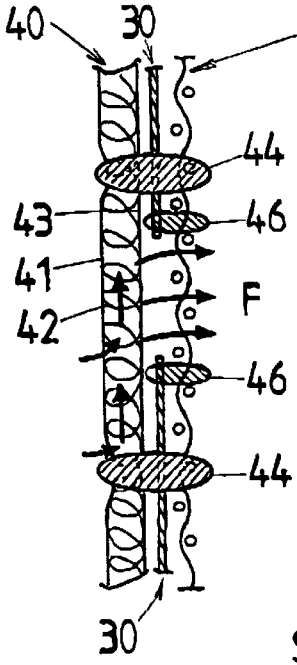
FIGS. 2A, 2B, and 2C are enlarged, cross-sectional views of a portion of various alternative embodiments of a ventilated shoe according to the present invention.

As depicted in FIG. 2A, the ventilated shoe 10 of the present invention is constructed using an external layer 20, a reinforcing layer 30, and an internal layer 40. Both the external layer 20 and the internal layer 40 are made from a ventilated mesh material. The internal layer 40 generally abuts the wearer's foot 2 (see FIG. 2B) or the wearer's sock 4 (see FIG. 2C) when the shoe 10 is positioned on the wearer's foot. In the preferred embodiment, the external layer 20 is made of mesh with abrasion resistance characteristics, and the internal layer 40 is made of a three-dimensional mesh which is more comfortable to the wearer then mesh. The three-dimensional mesh is a loose configuration of fibers 42 extending substantially perpendicularly between a soft porous inner layer 41 and an outer porous layer 43, which provide a porous layer that allows gases, such as air, and liquids, such as perspiration, to travel not only therethrough, but also in a direction substantially parallel to said layers 41, 43. Preferably, the three dimensional mesh material has a plurality of holes having a diameter in a range from 0.5 mm to 2 mm, although diameter holes that are either large or smaller than this preferred range can alternatively be used. Preferably, the ventilated mesh material of the external layer 20 has a plurality of holes having a diameter in a range from 0.5 mm to 2 mm, although diameter holes that are either large or smaller than this preferred range can alternatively be used.

Figure 2B:
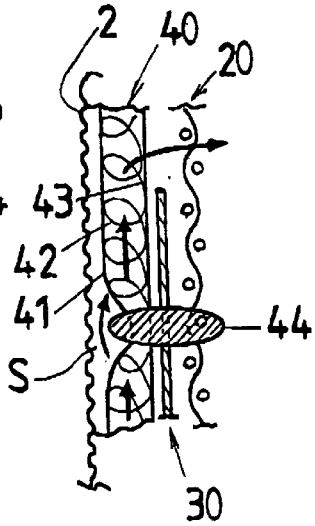
Figure 2C:
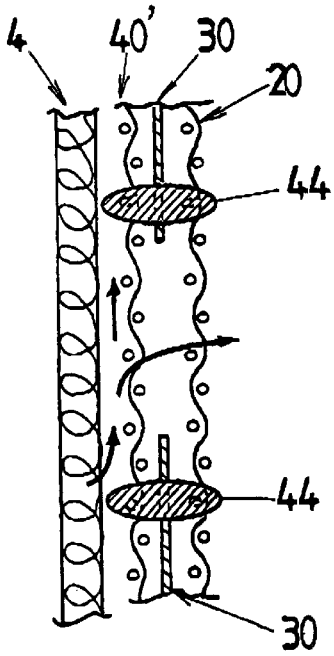

The reinforcing layer 30 depicted in FIGS. 2A, 2B, and 2C provides a means for reinforcing the shoe, and is generally positioned between a portion of the external layer 20 and the internal layer 40. By positioning the reinforcing layer 30 between the external layer 20 and the internal layer 40, the reinforcing layer 30 is isolated from both the wearer's foot and the exterior of the shoe, which allows the construction of the reinforcing layer 30 to be based solely on the traction resistance characteristics of the reinforcing layer 30, rather than aesthetic concerns, abrasion resistance concerns, or concerns over whether the reinforcing layer will create discomfort for the wearer. This configuration allows the reinforcing layer 30 to be constructed of inexpensive materials. The reinforcing layer 30 can be constructed from non-ventilated material such as non-woven material, or from ventilated material, such as breathable woven textiles, or unwoven textiles having small holes. The reinforcing layer 30 is sized and configured to permit the transmission (without deformation of the layer) of the fitting stress given by the shoes laces (not depicted) on the eyelets 22, to the sole portion 14 of the shoe 10. Due to its high traction resistance, i.e., low deformation under traction stress, the reinforcing layer 30 also provides the shoe 10 with better durability and better dimensional stability on the upper portion 12 of the shoe 10. While the reinforcing layer 30 provides durability and dimensional stability to the shoe 10, the amount of area of the shoe 10 that incorporates a reinforcing layer should be kept to a minimum because the reinforcing layer 30 is not generally as porous as the external layer 20 and the internal layer 40. One objective of the present invention is to construct a shoe 10 that is porous to allow fluids such as sweat and air to flow in and out of the shoe through the layers in order to keep the wearer's foot relatively cool and dry. The reinforcing layer 30 is preferably constructed to allow fluid to travel therethrough.

FIG. 4A depicts an embodiment of the reinforcing layer 30. The reinforcing layer 30 is configured to provide the maximum amount of structural stability and durability to the shoe, while generally being utilized over a minimum area of the shoe 10 in order to provide the shoe with the maximum porosity. The preferred embodiment of the reinforcing layer 30 has an end 31 that is located at the toe part 16 of the shoe, and an end 32 that is located at the heel part 18 of the shoe 10. The reinforcing layer 30 has a plurality of eyelet holes 34 that correspond to the eyelet holes 22 of the shoe 10, and an opening 35 that extends about the opening 19 of the shoe 10. Note, however, that in the preferred embodiment the opening 35 is not flush with opening 19, but rather dips downward toward the sole portion 14 of the shoe 10. The reinforcing layer 30 extends downward to a lower edge 38 that abuts the sole portion 14 of the shoe. The reinforcing layer 30 also advantageously includes one or more openings 36 that define open areas in the reinforcing layer. Since in the open areas within the openings 36 there are only two layers, specifically the external layer 20 and the internal layer 40, the open areas are more porous than areas that include the reinforcing layer 30 and therefore the open areas allow fluids to travel in and out of the shoe 10 more rapidly than in areas that include the reinforcing layer 30. The openings 36 have structural members 37 that extend therebetween. The structural members 37 are configured to extend from the eyelet holes 34 to the lower edge 38, thereby transmitting the traction stresses placed on the eyelet holes 22 of the shoe 10 by shoelaces to the sole portion 14 of the shoe 10. The openings 36 are preferably formed of curved shapes, which prevents a concentration of stresses that would be present in a shape having angled corners. The reinforcing layer 30 can alternatively be constructed to include apertures 39 which give the layer 30 increased porosity. The reinforcing layer 30 preferably extends along both sides of the shoe 10.

The shoe 10 of the present invention includes a means for connecting the external layer 20, the reinforcing layer 30, and the internal layer 40. The preferred means for connecting these layers is stitching, although other means for connecting can be used in some places or in combination with the stitching, such as glue. As compared to glue, the use of stitching improves significantly the ability of the layers to allow air, sweat, or other fluids to travel through the porous layers of the shoe, which can help keep the wearer's foot relatively cool and dry.

FIG. 2A depicts a stitch 44 that extends from the external layer 20, through the reinforcing layer 30, and connects to the internal layer 40. The stitch 44 is beneficial in that it provides the maximum interconnection between the three layers 20, 30, and 40, and therefore the maximum structural strength. The stitch 44 has the tendency to pinch or compress the various layers together. FIG. 2B depicts in a more detailed way the flow of fluids in the area of a stitch 44 along the internal layer 40 using arrows in a situation where the internal layer is adjacent the wearer's foot 2. In this situation, the fluid can travel both in a direction parallel to the layers 41, 43 along the length of the internal layer 40 (horizontally, vertically, and diagonally) through the stitching 44, and in the space S over the outside of the stitching 44 between the internal layer 40 and the foot 2.

FIG. 2C depicts the flow of fluids along an internal layer 40' using arrows in a situation where the internal layer is adjacent the wearer's sock 4. The internal layer 40' is constructed of a mesh material which can be similar or different to that used for the external layer 20. In this situation, the fluid can travel both along the length of the internal layer 40' under the stitching 44, however, the fluid will most readily travel around the outside of the stitching 44 and along the fabric of the sock 4. In this embodiment, the internal layer 40 is not a three dimensional mesh, to enable the use of the shoe with a sock 4 in such a three dimensional material.

FIG. 2A depicts a second stitch 46 that connects the external layer 20 to the reinforcing layer 30. The stitch 46 does not restrict the free flow of fluid along the internal layer 40, which allows the fluid to travel along the internal layer 40 and exit the shoe 10 via the open areas, for example the open areas defined by openings 36, where a reinforcing layer is not present. The stitch 46 provides some structural stability and fixes the positioning of the reinforcing layer 30.

Figure 3A:
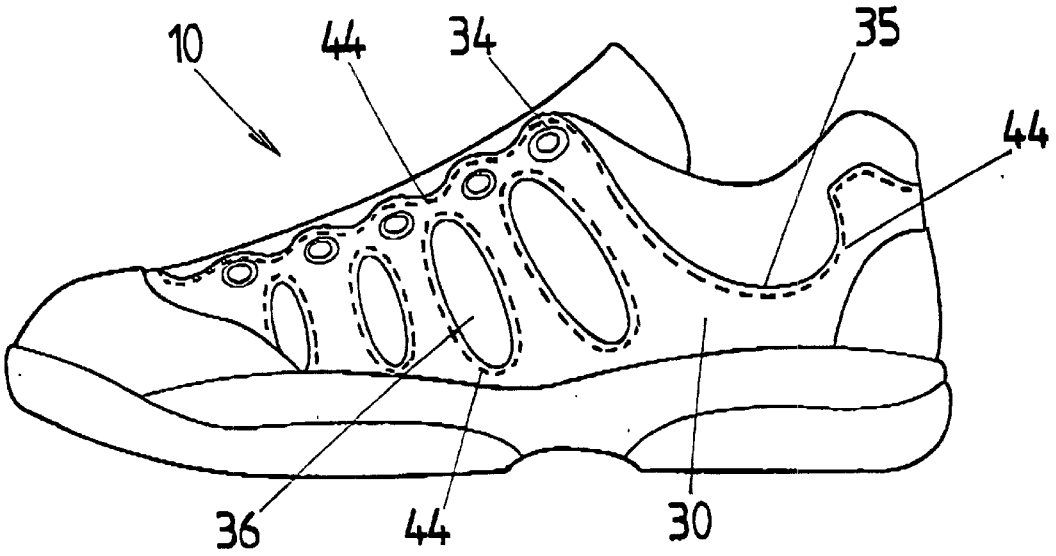
FIGS. 3A and 3B are side views of a different embodiments of a ventilated shoe with the external layer removed according to the present invention, which depict alternative stitching configurations.

FIG. 3A depicts an embodiment of the shoe 10 according to the present invention, which corresponds to the embodiment depicted in FIG. 2B. The shoe 10 includes a plurality of stitches 44, although additional stitching which is not depicted may be used to construct the shoe 10. FIG. 3A depicts exemplary locations for stitching 44. The stitching 44 can be used along the boundaries of the reinforcing layer 30 to secure the layer 30 to the external layer 20 and the internal layer 40. The stitching 44 can be used along the edges of the openings 36 of the reinforcing layer 30, along the opening 35, and along the edge of the reinforcing layer 30 adjacent the eyelet holes 34, as depicted in FIG. 3A.

Figure 3B:
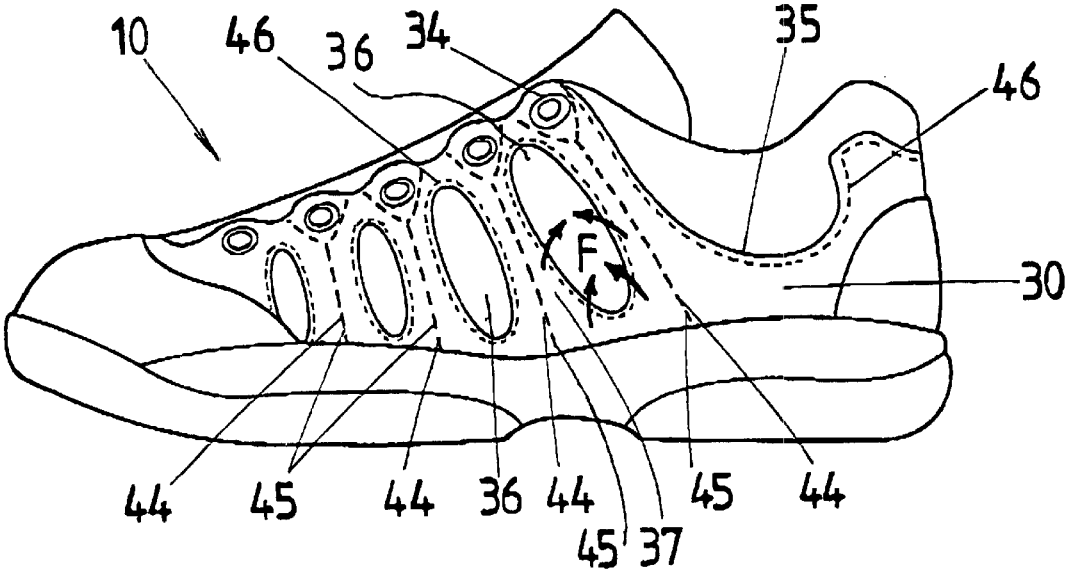
Figure 6:
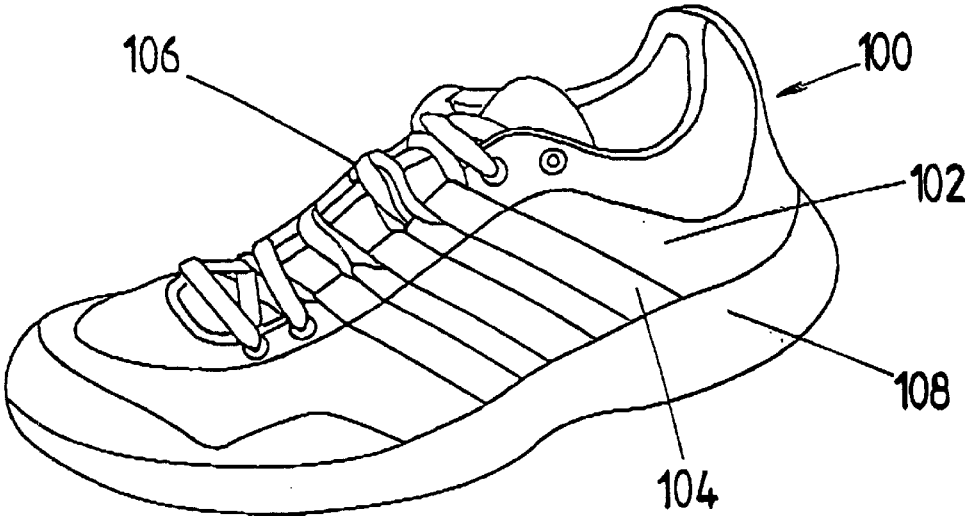
FIG. 6 is a perspective view of a first related art shoe.
Figure 7:
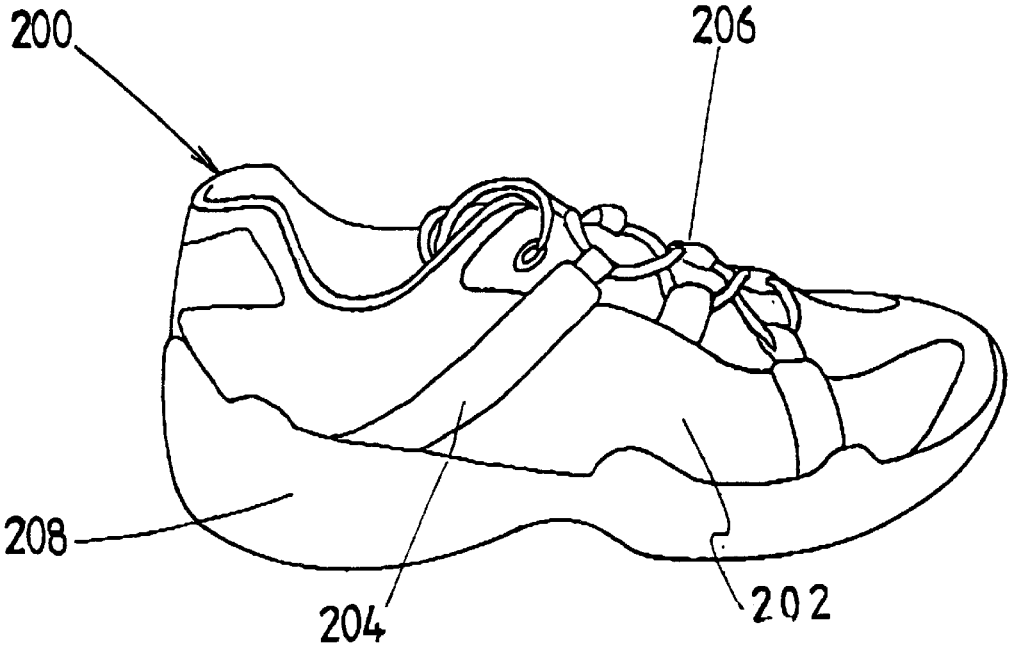
FIG. 7 is a perspective view of a second related art shoe.

FIG. 3B depicts another embodiment of the shoe 10 according to the present invention which corresponds to the embodiment depicted in FIG. 2A. The embodiment depicted in FIG. 3B includes a plurality of stitches 44 as well as a plurality of stitches 46, although additional stitching which is not depicted may be used to construct the shoe 10. FIG. 3B depicts exemplary locations for stitching 44 and 46. The stitching 46 can be used along the boundaries of the reinforcing layer 30 to secure the layer 30 to the external layer 20. The stitching 46 can be used along the edges of the openings 36 of the reinforcing layer 30, and along the opening 35. The stitching 44 can be used as a reinforcing structure by forming stitching lines 45 extending in a direction from the eyelet holes 34 and downward along the structural member 37 to the sole portion 14 of the shoe 10, as depicted in FIG. 3B. The stitching lines 45 transmit stresses placed on the eyelet holes 22 of the shoe 10 by shoelaces to the sole portion 14 of the shoe 10. The stresses on the eyelet holes 22 extend in a direction generally coextensive with the stitching lines 45. The stitching lines 45 define different areas of the upper part of the shoe 10. Each area preferably includes at least one opening 35, 36 in the reinforcing layer 30. As evidenced by arrows F in FIGS. 2A and 3B, in each such area, the fluid travels in a direction parallel to the layers 41, 43 along the length of the internal layer 40 and through the openings 36.

As depicted in FIG. 1, the shoe 10 of the present invention preferably further includes a first secondary reinforcement layer 50 attached on an exterior surface of the external layer 20 at the toe part 16 and a second secondary reinforcement layer 52 attached on an exterior surface of the external layer 20 at a heel part 18 of the shoe 10. The secondary reinforcement layers 50 and 52 are constructed to provide protection to the shoe 10 at high contact areas of the shoe 10, specifically the toe part 16 and the heel part 18, where a wearer tends to hit the shoe on the ground or objects. The secondary reinforcement layers 50 and 52 are preferably made of ventilated material, such as nylon mesh or grid, or other mesh materials, and are preferably fixed to the shoe 10 with stitching not represented on the drawing.

The shoe 10 of the present invention preferably further includes a secondary reinforcement layer 54 (depicted in phantom lines in FIG. 1) attached on an interior surface of the internal layer 40 at an eyelet part of the shoe 10. The secondary reinforcement layer 54 (depicted in phantom lines in FIG. 1) is preferably made of a material that is soft and therefore comfortable for the wearer, since layer 54 is on the interior of the shoe 10.

The shoe 10 of the present invention preferably further includes a first reinforcement member 60, as depicted in FIG. 4B, and a second reinforcement member 64, as depicted in FIG. 4C. The first reinforcement member 60 is attached either between the external layer 20 and the reinforcing layer 30, between the reinforcing layer 30 and the internal layer 40, or between the external layer 20 and the secondary reinforcement layer 50 at the toe part 16 of the shoe 10 generally below the secondary reinforcement layer 50. The second reinforcement member 64 is attached either between the external layer 20 and the reinforcing layer 30, between the reinforcing layer 30 and the internal layer 40, or between the external layer 20 and the secondary reinforcement layer 52 at the heel part 18 of the shoe 10 generally below the secondary reinforcement layer 52. The reinforcement members 60 and 64 are constructed to provide protection to the shoe 10 at high contact areas of the shoe 10, specifically the toe part 16 and the heel part 18, where a wearer tends to hit the shoe on the ground or objects. The reinforcement members 60 and 64 are preferably made of a semi-rigid plastic material or other similar material, and are preferably fixed to the shoe 10 with stitching and/or with glue. The reinforcement members 60 and 62 can be provided with apertures or holes 62 and 66, respectively, to make the members 60 and 62 ventilated. The apertures 62 and 66 preferably have a diameter in a range from 1mm to 5mm. In general, the upper portion 12 of the shoe is assembled substantially only by stitching to improve breathabilty, and glue is used only in some very limited areas such as in connection with the reinforcement members 60 and 64.

As depicted in FIGS. 1 and 5, the shoe 10 of the present invention preferably includes a tongue portion 70. The tongue portion 70 includes a layer of ventilated foam 72 positioned beneath the external layer 20. The tongue portion 70 also includes an inner cleanliness textile 76. The foam 72 also includes a plurality of holes 74. The tongue 70 is mainly assembled by stitching.

The shoe 10 of the present invention preferably includes a layer of foam 80 (depicted in phantom lines in FIG. 1) extending about the ankle portion 19. The foam 80 is preferably ventilated foam and is positioned beneath the external layer 20 of the shoe 10.

Numerous variations of the present invention are possible in light of the above teachings. It is therefore to be understood that within the scope of the appended claims, the present invention can be practiced other than as specifically described herein.

What is new and desired to be secured by Letters Patent of the United States is:

1. A ventilated shoe comprising:

a first layer made of a ventilated mesh material;

a second layer made of a ventilated mesh material;

a means for reinforcing said shoe positioned between a portion of said first layer and a portion of said second layer; and a means for connecting said first layer, said second layer, and said means for reinforcement, wherein one of said first layer and said second layer is provided as an internal layer, and wherein said internal layer is made of a three dimensional mesh material.

2. The ventilated shoe according to claim 1, wherein said reinforcing means includes a reinforcement layer made of a ventilated material.

3. The ventilated shoe according to claim 1, wherein said connecting means includes a first plurality of stitches that extend through said reinforcing means and connects said first layer with said second layer.

4. The ventilated shoe according to claim 3, wherein said connecting means further includes a second plurality of stitches connecting said second layer and said reinforcing means.

5. The ventilated shoe according to claim 1, wherein said connecting means includes a plurality of stitches that extend through said reinforcing means and connects said first layer with said second layer, said plurality of stitches extending from an eyelet portion of said shoe to a sole portion of said shoe along a direction of stresses extending from an upper portion of said shoe to a sole portion of said shoe.

6. The ventilated shoe according to claim 1, wherein said second layer and said reinforcing means are connected by a plurality of stitches extending about an outer boundary of said reinforcing means.

7. The ventilated shoe according to claim 1, further comprising a first secondary reinforcement layer attached on an exterior surface of said second layer at a toe part and a second secondary reinforcement layer attached on an exterior surface of said second layer at a heel part of said shoe.

8. The ventilated shoe according to claim 1, further comprising a first reinforcement member positioned between said first layer and said second layer at a toe part and a second reinforcement member positioned between said first layer and said second layer at a heel part of said shoe.

9. The ventilated shoe according to claim 8, wherein said first and second reinforcement members are made of plastic and have a plurality of holes having a diameter in a range from 1 mm to 5 mm.

10. The ventilated shoe according to claim 1, further comprising a secondary reinforcement layer attached on an interior surface of said first layer at an eyelet part of said shoe.

11. The ventilated shoe according to claim 1, wherein said ventilated shoe is provided with a ventilated construction over substantially an entire area of said ventilated shoe.

12. The ventilated shoe according to claim 1, wherein said first layer, said second layer, and said means for reinforcing are attached together substantially without glue.

13. The ventilated shoe according to claim 1, wherein said means for reinforcing includes an opening defining an open area, said first layer and said second layer extend over said open area.

14. The ventilated shoe according to claim 1, wherein said means for reinforcing includes a reinforcement layer made of non-woven material.

15. The ventilated shoe according to claim 14, wherein said reinforcement layer has a plurality of ventilation holes.

16. The ventilated shoe according to claim 1, wherein said means for reinforcing includes a reinforcement layer made of woven textiles.

17. A ventilated shoe comprising:

an internal layer made of a ventilated mesh material;

an external layer made of a ventilated mesh material and having a portion connected to said internal layer; and a reinforcement layer positioned between a portion of said internal layer and a portion of said external layer, said reinforcement layer having a portion connected to said external layer, wherein said internal layer is made of a three dimensional mesh material.

18. The ventilated shoe according to claim 1, wherein said three dimensional mesh material has a plurality of holes having a diameter in a range from 0.5 mm to 2 mm.

19. The ventilated shoe according to claim 17, wherein said internal layer and said external layer are connected by a first plurality of stitches that extend through said reinforcement layer.

20. The ventilated shoe according to claim 1, wherein said external layer and said reinforcement layer are connected by a second plurality of stitches.

21. The ventilated shoe according to claim 17, wherein said internal layer and said external layer are connected by a plurality of stitches that extend through said reinforcement layer, said plurality of stitches extending from an eyelet portion of said shoe to a sole portion of said shoe along a direction of stresses extending from an upper portion of said shoe to a sole portion of said shoe.

22. The ventilated shoe according to claim 17, wherein said external layer and said reinforcement layer are connected by a plurality of stitches extending about an outer boundary of said reinforcement layer.

23. The ventilated shoe according to claim 17, wherein said reinforcement layer is made of a ventilated material.

24. The ventilated shoe according to claim 17, further comprising a first secondary reinforcement layer attached on an exterior surface of said external layer at a toe part and a second secondary reinforcement layer attached on an exterior surface of said external layer at a heel part of said shoe.

25. The ventilated shoe according to claim 24, wherein said first and second secondary reinforcement layers are fixed to said external layer by glue.

26. The ventilated shoe according to claim 17, further comprising a tongue portion of said shoe including a layer of ventilated foam positioned beneath said external layer.

27. The ventilated shoe according to claim 17, further comprising an ankle portion of said shoe including a layer of ventilated foam positioned beneath said external layer.

28. The ventilated shoe according to claim 17, wherein said shoe includes an upper portion and a sole portion, said upper portion being fixed to said sole portion by glue.

29. The ventilated shoe according to claim 17, wherein said ventilated mesh material of said external layer has a plurality of holes having a diameter in a range from 0.5 mm to 2 mm.

30. The ventilated shoe according to claim 17, further comprising a first reinforcement member positioned between said internal layer and said external layer at a toe part and a second reinforcement member positioned between said internal layer and said external layer at a heel part of said shoe.

31. The ventilated shoe according to claim 30, wherein said first and second reinforcement members are made of plastic and have a plurality of holes having a diameter in a range from 1 mm to 5 mm.

32. The ventilated shoe according to claim 17, further comprising a secondary reinforcement layer attached on an interior surface of said internal layer at an eyelet part of said shoe.

33. The ventilated shoe according to claim 17, wherein said ventilated shoe is provided with a ventilated construction over substantially an entire area of said ventilated shoe.

34. The ventilated shoe according to claim 17, wherein said internal layer, said external layer, and said reinforcement layer are attached together substantially without glue.

35. The ventilated shoe according to claim 17, wherein said reinforcement layer includes an opening defining an open area, said internal layer and said external layer extend over said open area.

36. The ventilated shoe according to claim 17, wherein said reinforcement layer is made of non-woven material.

37. The ventilated shoe according to claim 36, wherein said reinforcement layer has a plurality of ventilation holes.

38. The ventilated shoe according to claim 17, wherein said reinforcement layer is made of woven textiles.

* * * * *